US007878844B2

(12) United States Patent
Weidner

(10) Patent No.: US 7,878,844 B2
(45) Date of Patent: Feb. 1, 2011

(54) PANEL CONNECTOR ASSEMBLY

(75) Inventor: Kevin E. Weidner, Hummelstown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 93 days.

(21) Appl. No.: 12/350,640

(22) Filed: Jan. 8, 2009

(65) Prior Publication Data

US 2010/0173520 A1 Jul. 8, 2010

(51) Int. Cl.
*H01R 13/66* (2006.01)

(52) U.S. Cl. ..... 439/533; 439/939

(58) Field of Classification Search ..... 439/533, 439/557, 562–564, 939
See application file for complete search history.

(56) References Cited

U.S. PATENT DOCUMENTS 4,902,242 A 2/1990 Davis et al.
5,766,041 A 6/1998 Morin et al.
6,749,448 B2 6/2004 Bright et al.
6,752,663 B2 6/2004 Bright et al.
6,816,376 B2 11/2004 Bright et al.
6,926,565 B2 8/2005 Fogg
7,007,217 B2 2/2006 Fujii et al.
7,025,617 B2 4/2006 Regnier et al.
7,048,567 B2 5/2006 Regnier et al.
7,090,523 B2 8/2006 Shirk et al.
7,198,519 B2 4/2007 Regnier et al.

OTHER PUBLICATIONS

QSL RF Connector System, © Copyright 2007 by Tyco Electronics Corporation, 8 pgs.

*Primary Examiner*—Khiem Nguyen

(57) ABSTRACT

A panel connector assembly includes a panel, a panel connector and a mounting bracket. The panel has opposing front and rear sides and includes a connector opening and a securing hole extending through the panel. The panel connector is disposed proximate to the panel and has a mating face aligned with the connector opening in the panel. The panel connector is positioned to couple with a peripheral connector that mates with the mating face through the front side of the panel. The mounting bracket is disposed proximate to the rear side of the panel. The mounting bracket receives a securing feature of the peripheral connector that extends through the securing hole in the panel to the mounting bracket when the peripheral connector and panel connector mate with one another. The mounting bracket receives the securing feature to secure the peripheral connector to the front, side of the panel.

10 Claims, 6 Drawing Sheets

PANEL CONNECTOR ASSEMBLY

BACKGROUND OF THE INVENTION

The subject matter herein relates generally to electrical connectors, and more particularly, to electrical connectors mounted to a panel of an electrical device or system.

Known electrical systems and devices today are designed to include panel-mounted connectors positioned along the panels or walls of an electrical system or device, such as a portable computer. For example, some devices may include connector receptacles disposed on an exterior panel or chassis. Peripheral connectors that are coupled to one or more external devices may mate with the panel-mounted receptacle to permit communication between the external devices and the devices housing the panel-mounted connectors. The peripheral connector may include a plug end that is received through a mating face of the panel mounted connector to establish an electrically conductive pathway between the peripheral connector and the panel-mounted connector. The mating face of the panel mounted connector may be disposed proximate to the panel.

Some of the known panel-mounted connectors are secured to the panels using a snap-fit coupling. For example, a panel-mounted connector may be mounted to a panel by loading the connector through an opening in the panel. The connector may be loaded from the front side of the panel, or the exterior side of the device. Spring fingers or extensions of the connector may permit the connector to be front loaded into the panel opening. But, these same spring fingers or extensions impede removal of the connector through the opening once the connector is loaded in the opening. The connector is sized to fit within the opening and cannot have a larger cross-sectional shape than the opening. For example, the size of the mating face of the connector is established to be no larger than the panel opening. If the mating face were too large, the connector may not be capable of being front loaded into the panel. As a result, known front, loaded panel-mounted connectors do not include mounting ears or other components near the mating face that provide a method of securing the peripheral connector and panel-mounted connector together. Instead, the peripheral connector is merely placed into the panel-mounted connector. The peripheral connector may be inadvertently removed from the panel-mounted connector and therefore separate the peripheral and panel-mounted connectors from a mated relationship. Thus, a need exists for a panel connector assembly that secures a peripheral connector to a front loaded, panel-mounted connector to prevent removal of the peripheral connector from the panel-mounted connector.

BRIEF DESCRIPTION OF THE INVENTION

In one embodiment, a panel connector assembly is provided. The connector assembly includes a panel, a panel connector and a mounting bracket. The panel has opposing front and rear sides and includes a connector opening and a securing hole extending through the panel. The panel connector is disposed proximate to the panel and has a mating face aligned with the connector opening in the panel. The panel connector is positioned to couple with a peripheral connector that mates with the mating face through the front side of the panel. The mounting bracket is disposed proximate to the rear side of the panel. The mounting bracket receives a securing feature of the: peripheral connector that extends through the securing hole in the panel to the mounting bracket when the peripheral connector and panel connector mate with one another. The mounting bracket receives the securing feature to secure the peripheral connector to the front side of the panel.

In another embodiment, another panel connector assembly is provided. The connector assembly includes a panel and a panel connector. The panel has opposing front and rear sides with a connector opening extending through the panel. The panel also includes a mounting bracket that is spaced apart from the rear side of the panel. The panel connector is mounted to the rear side of the panel. The panel connector includes a mating face that, is positioned to couple with a peripheral connector through the connector opening in the panel. The panel connector also includes a mounting ear protruding from the panel connector. The mounting bracket receives the mounting ear to prevent the panel connector from being removed from the panel.

DETAILED DESCRIPTION OF THE INVENTION

Figure 1:
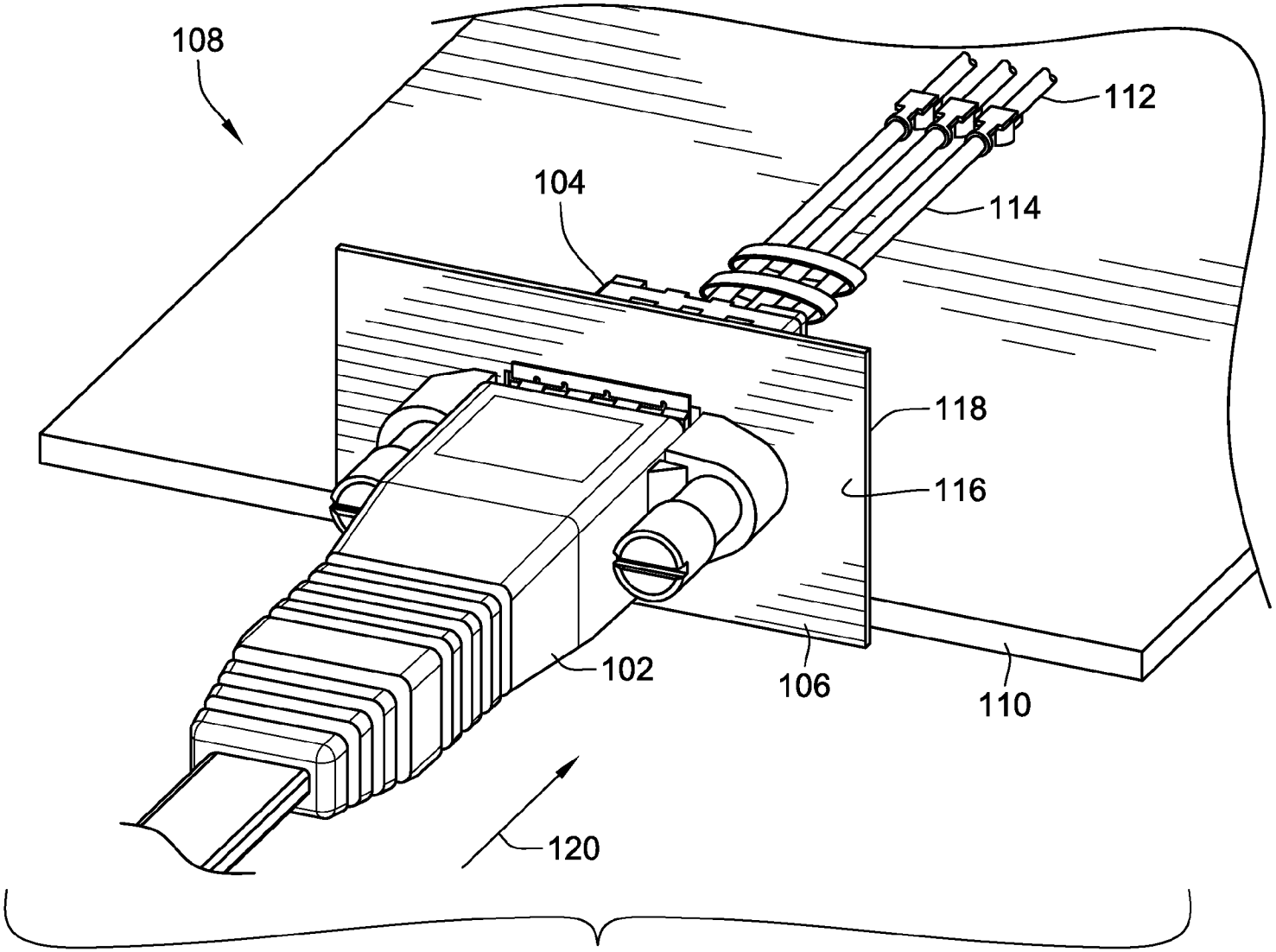
FIG. 1 is a perspective view of a panel connector assembly implemented according to one embodiment.

FIG. 1 is a perspective view of a panel connector assembly 100 implemented according to one embodiment. The connector assembly 100 shown in FIG. 1 includes a peripheral connector 102 mated with a panel connector 104. The peripheral connector 102 is electronically coupled to one or more peripheral devices (not shown). The panel connector 104 is joined to a device 108. The peripheral connector 102 and the panel connector 104 mate to permit electronic communication between the peripheral device and the device 108. By way of example only, the peripheral connector 102 may be joined to an antenna device such as a mobile antenna or an RF antenna, while the panel connector 104 may be joined to a computing device such as a Global Positioning System ("GPS") device, a radio device, a handheld computing device such as a Personal Digital Assistant ("PDA"), a mobile phone, an automotive telematic device, a WiFi device, a WiMax device, a data device, and the like. Other devices than those listed above may be joined with the peripheral connector 102 or the panel connector 104.

The panel connector 104 is mounted to a panel 106 of the device 108. In one embodiment, the panel connector 104 is a front loaded, panel-mounted connector. For example, the panel connector 104 may be mounted to the panel 106 by loading the panel connector 104 into a connector opening 200 (shown in FIG. 2) through a front side 116 of the panel 106. The panel 106 may represent a portion of the exterior of the device 108 or an internal wall or chassis of the device 108. For example, the panel may include opposing front and rear sides 116, 118, with the front side 116 forming part of an exterior surface of the device 108 and the rear side 118 forming part of an interior surface of the device 108. In one embodiment, the panel 106 may provide structural support for panel-mounted connectors such as the panel connector 104, but does not provide conductive pathways for the communication of data signals such as power or communication signals. As shown in FIG. 1, the peripheral connector 102 mates with the panel connector 104 from the front side 116 of the panel 106. For example, the peripheral connector 102 may couple with the panel connector 104 by moving the peripheral connector 102 in a mating direction 120 toward the front side 116 of the panel 106.

The device 108 includes a substrate 110 having conductive pathways 112. The substrate 110 may be embodied in a printed circuit board, with the conductive pathways 112 including conductive traces, for example. The panel connector 104 is electronically joined to the conductive pathways 112 via one or more cables 114. The conductive pathways 112 and cables 114 permit communication between the peripheral device (not shown) and the device 108 via the peripheral connector 102 and the panel connector 104.

Figure 2:
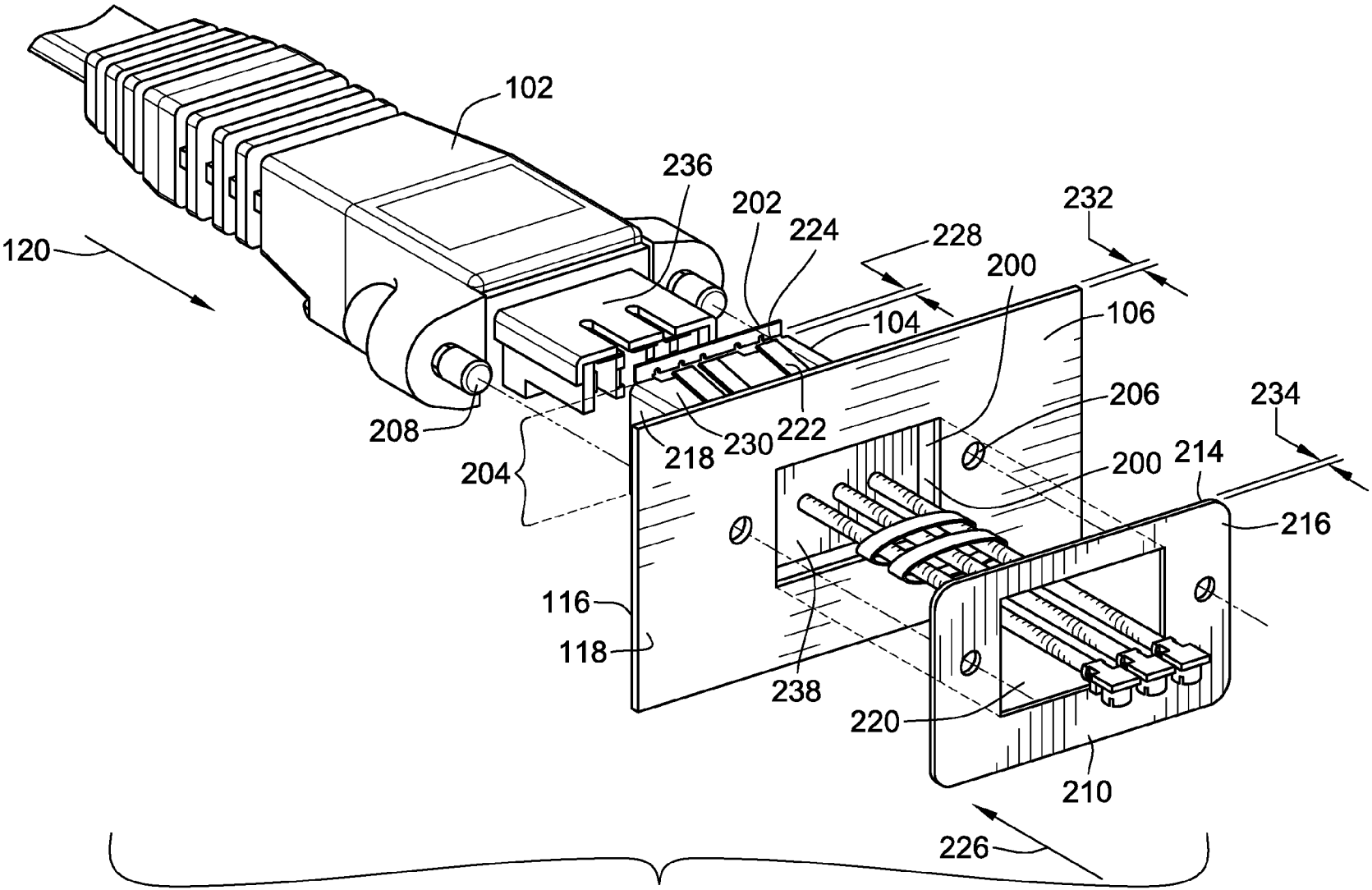
FIG. 2 is an exploded view of the connector assembly shown in FIG. 1.

FIG. 2 is an exploded view of the connector assembly 100. The panel 106 includes a connector opening 200 through which the panel connector 104 is loaded. For example, the panel connector 104 may be mounted to the panel 106 by inserting the panel connector 104 in the connector opening 200 from the front side 116 of the panel 106 in a direction parallel to the mating direction 120. The connector opening 200 extends through the panel 106 from the front side 116 to the rear side 118. Once loaded in the connector opening 200, the panel connector 104 may be aligned with the connector opening 200. For example, a mating face 204 of the panel connector 104 may be aligned with respect to the connector opening 200 in a direction parallel to the mating direction 120. The mating face 204 may be aligned with the connector opening 200 such that the mating face 204 is coextensive with the connector opening 200 and the panel 106 frames the mating face 204. In the illustrated embodiment, the mating face 204 of the panel connector 104 is the interface through which a plug end 236 of the peripheral connector 102 is received to mate the peripheral connector 102 with the panel connector 104. The plug end 236 may be received in the panel connector 104 by passing the plug end 236 through the connector opening 200 from the front side 116 of the panel 106. Alternatively, the panel connector 104 may be received in the peripheral connector 102. For example, the panel connector 104 may include a plug end that is received in a mating face of the peripheral connector 102. The mating face 204 may be coplanar with the front side 116 or rear side 118 of the panel 106. Alternatively, the mating face 204 may protrude out of the device 108 past the front side 116. In another embodiment, the mating face 204 is recessed into the device 108 past the rear side 118. Optionally, the mating face 204 may be disposed between the front and rear sides 116, 118.

In the illustrated embodiment, the panel 106 includes securing holes 206 that extend through the panel 106 from the front side 116 to the rear side 118. The securing holes 206 are sized and positioned relative to the connector opening 200 in order to receive securing features 208 of the peripheral connector 102. For example, the securing features 208 may include threaded screws that secure the peripheral connector 102 and the panel connector 104 together. The securing holes 206 are through holes in the embodiment shown in FIG. 2. Alternatively, the securing holes 206 may be threaded holes that engage the threaded screws of the securing features 208 to secure the peripheral connector 102 to the panel 106. In another embodiment the securing holes 206 may not have a threaded surface but may be sized to engage the threaded screws of the securing features 208 of the peripheral connector 102.

The connector assembly 100 includes a mounting bracket 210. The mounting bracket 210 is a substantially planar body that includes a panel side 214 and a connector side 216 in the illustrated embodiment. The mounting bracket 210 is formed as a collar that circumscribes a connector opening 220. In one embodiment, the mounting bracket 210 secures the panel connector 104 to the rear side 118 of the panel 106 and secures the peripheral connector 102 to the front side 116 of the panel 106 in a mated relationship with the panel connector 104. The mounting bracket 210 may be placed around the panel connector 104 after the panel connector 104 is loaded into the connector opening 200 in the panel 106. While the panel connector 104 may be loaded into the connector opening 200 from the mating direction 120 toward the front side 116 of the panel 106, the mounting bracket 210 may be placed around the panel connector 104 from the opposing direction 226 toward the rear side 118 of the panel 106.

The panel connector 104 includes a shield 218 that at least partially surrounds a body 238 of the connector 104. The shield 218 may be electrically coupled to a ground reference of the substrate 110 (shown in FIG. 1) to electrically shield the panel connector 104. The shield 218 includes several tabs 222 that forwardly protrude from the shield 218 proximate the body 238. In the illustrated embodiment, each of the tabs 222 is a cantilevered beam that extends between the shield 218 and an end surface 224. The tabs 222 may provide a snap-in securing method of retaining the panel connector 104 in the panel 106. For example, the end surfaces 224 of the tabs 222 may be separated from the body 238 of the connector 104 such that the tabs 222 prevent the panel connector 104 from being removed from the panel 106 through the connector opening 200 in a direction 226 that opposes the mating direction 120. The tabs 222 may be biased toward the body 238 of the panel connector 104 as the panel connector 104 is loaded through the connector opening 200 in the panel 106 in the mating direction 120. The tabs 222 may return to an unbiased position after the panel connector 104 is loaded through the connector opening 200 past a position where the tabs 222 no longer contact the panel 106. The tabs 222 may then prevent the panel connector 104 from passing through the connector opening 200 in the direction 226 without biasing the tabs 222 toward the body 238.

The shield 218 also includes a flange 202 located proximate to the mating face 204. The flange 202 may protrude from the panel connector 104 in a direction parallel with the mating face 204. The flange 202 engages the front side 116 of the panel 106 when the panel connector 104 is loaded into the connector opening 200. The flange 202 may contact the front side 116 of the panel 106 to prevent the panel connector 104 from passing through the connector opening 200 and being removed toward the rear side 118 of the panel 106. For example, the flange 202 may prevent the panel connector 104 from being removed from the panel 106 in a direction along the mating direction 120.

The flange 202 and end surfaces 224 of the tabs 222 may be separated from one another by a separation gap 228. The separation gap 228 may be measured along a direction that is perpendicular to the flange 202 or parallel to an upper surface 230 of the panel connector 104. In one embodiment the separation gap 228 is dimensioned approximately the same as a panel thickness 232 plus a mounting bracket thickness 234. The panel thickness 232 is the thickness of the panel 106 measured in a direction that is perpendicular to the front and rear sides 116, 118 of the panel 106. The mounting bracket thickness 234 is the thickness of the mounting bracket 210 measured in a direction that is perpendicular to the opposing sides 214, 216 of the mounting bracket 210.

Figure 3:
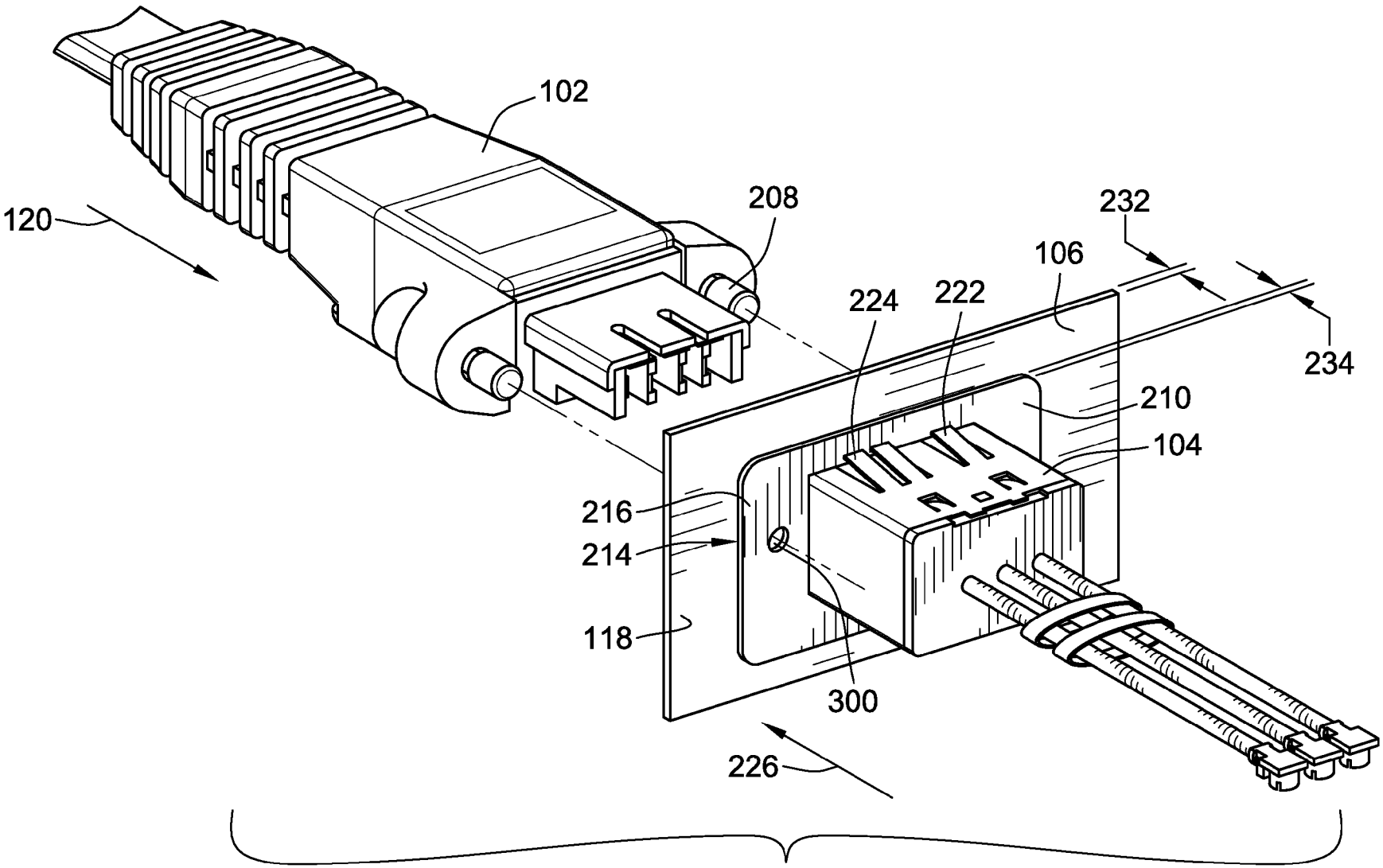
FIG. 3 is a rear perspective view of the connector assembly shown in FIG. 1.

FIG. 3 is a rear perspective view of the connector assembly 100. In order to secure the panel connector 104 to the panel 106, the panel connector 104 is loaded into the connector opening 200 from the mating direction 120 until the tabs 222 are inserted past the panel 106. The mounting bracket 210 is then placed over the panel connector 104 from the opposing direction 226. In the illustrated embodiment, the mounting bracket 210 is moved along the opposing direction 226 until the panel side 214 of the mounting bracket 210 engages the rear side 118 of the panel 106. Alternatively, a gasket or other component may be disposed between the rear side 118 of the panel 106 and the panel side 214 of the mounting bracket 210. The connector side 216 of the mounting bracket 210 may engage the panel connector 104 when the mounting bracket 210 is placed over the panel connector 104. For example, the mounting bracket 210 may be retained between the end surfaces 224 of the tabs 222 and the panel 106. The tabs 222 may provide a snap-in connection to retain the mounting bracket 210. Similar to the loading of the panel connector 104 in the panel 106, the tabs 222 may be biased toward the panel connector 104 as the mounting bracket 210 is positioned over the panel connector 104. Once the mounting bracket 210 is moved sufficiently far past the tabs 222, the tabs 222 may return to an unbiased position to secure the mounting bracket 210 between the tabs 222 and the panel 106. The tabs 222 may secure the mounting bracket 210 such that the connector openings 200, 220 (shown in FIG. 2) are aligned with respect to one another. In the illustrated embodiment, the mounting bracket 210 concurrently engages the tabs 222 and the panel 106. For example, the panel side 214 of the mounting bracket 210 may engage the rear side 118 of the panel 106 at the same time that the connector side 216 of the mounting bracket 210 engages the end surfaces 224 of the tabs 222.

As described above, the separation gap 228 (shown in FIG. 2) between the flange 202 (shown in FIG. 2) and the end surfaces 224 of the tabs 222 may be approximately the same as the combined thicknesses 232, 234 of the panel 106 and the mounting bracket 210. In one embodiment, the end surfaces.224 may engage the mounting bracket 210 to secure the panel connector 104 in the panel 106 such that the panel connector 104 is retained in a position where the mating face 204 (shown in FIG. 2) is aligned with the connector opening 200 (shown in FIG. 2) in the panel 106.

The mounting bracket 210 includes securing holes 300 that may receive the securing features 208 of the peripheral connector 102. The securing holes 300 may be threaded holes axially aligned with the securing holes 206 (shown in FIG. 2) of the panel 106. Alternatively, the securing holes 300 may not be threaded but may be sized to engage the threaded securing features 208 of the peripheral connector 102. In order to secure the peripheral connector 102 and the panel connector 104 in a mated relationship, the securing features 208 may extend through the securing holes 206 in the panel 106 and into the securing holes 300 of the mounting bracket 210 when the peripheral connector 102 mates with the panel connector 104. The securing features 208 may be rotated to create a threaded engagement between the securing features 208 and one or more of the securing holes 206 (shown in FIG. 2), 300 of the panel 106 and/or mounting bracket 210. This engagement may exert a force on the mounting bracket 210 in a direction parallel to the opposing direction 226. For example, the securing features 208 and securing holes 206, 300 may force the mounting bracket 210 toward the rear side 118 of the panel 106. The engagement between the securing features 208 and the securing holes 206, 300 may prevent the peripheral connector 102 from being separated from the panel connector 104.

Figure 4:
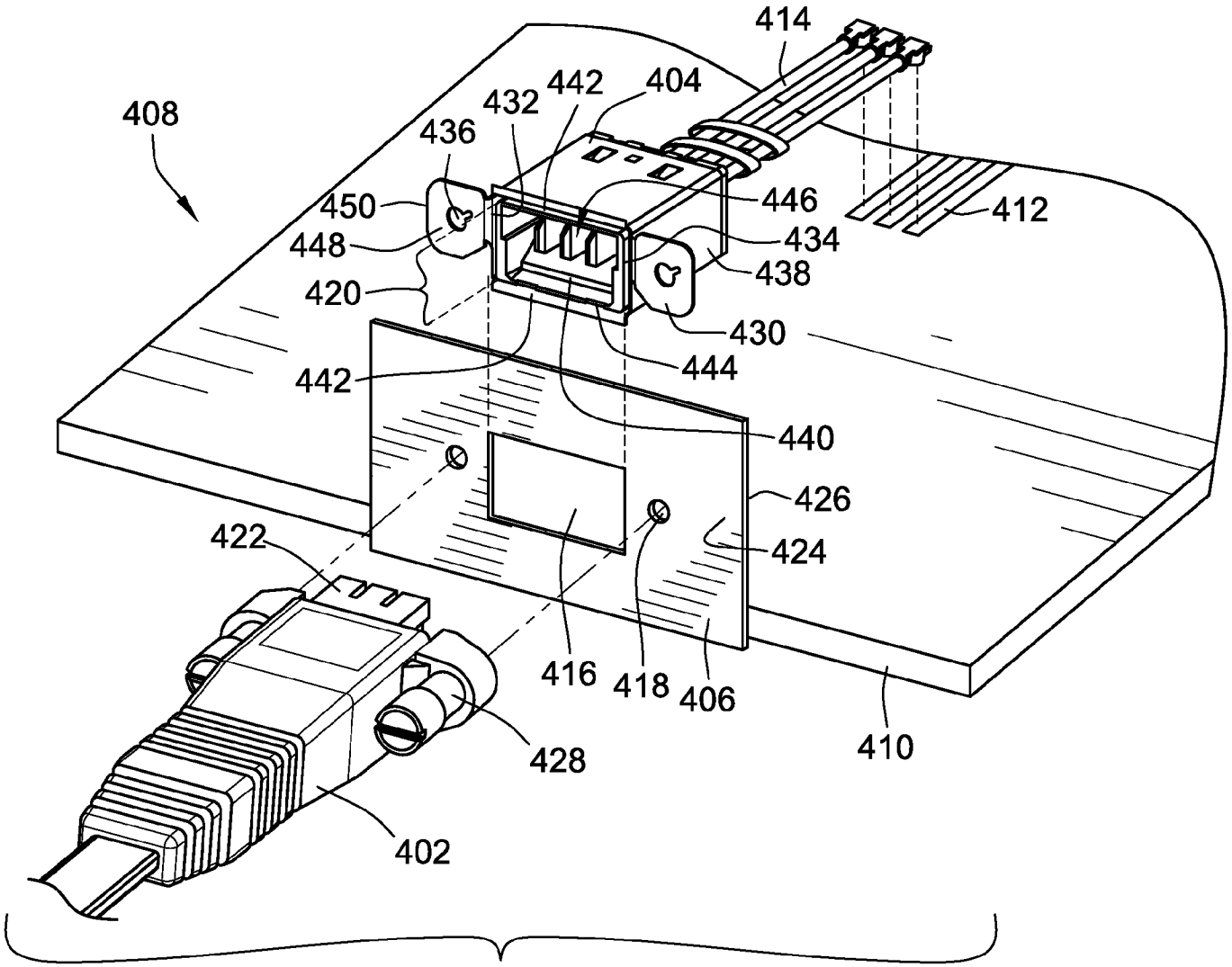
FIG. 4 is an exploded view of a panel connector assembly that is formed in accordance with an alternative embodiment.

FIG. 4 is an exploded view of a panel connector assembly 400 that is formed in accordance with an alternative embodiment. The connector assembly 400 is similar to the connector assembly 100 shown in FIG. 1. For example, the connector assembly 400 may include a panel connector 404 that is mounted to a panel 406 of a device 408. In one embodiment, the panel connector 404 is a front loaded, panel-mounted connector. The connector assembly 400 includes a peripheral connector 402 that mates with the panel connector 404 to permit communication between a peripheral device (not shown) and the device 408. The device 408 includes the panel 406 to which the panel connector 404 is mounted. The device 408 also includes a substrate 410 having conductive pathways 412. The substrate 410 may include a printed circuit board having conductive traces. Cables 414 of the panel connector 404 mount to the substrate 410 to provide an electrically conductive path between the panel connector 404 and the conductive pathways 412.

The panel 406 includes opposing front and rear sides 424, 426 with a connector opening 416 extending through the panel 406. The front side 424 may be an external surface of the device 408 and the rear side 426 may be an internal surface of the device 408. The panel connector 404 includes a mating face 420 that receives a plug end 422 of the peripheral connector 402 to mate the peripheral connector 402 and the panel connector 404. The panel connector 404 is mounted to the panel 406 such that the mating face 420 of the panel connector 404 is aligned with the connector opening 416. For example, the mating face 420 may be coextensive with the connector opening 416 such that the mating face,420 is framed by the panel 406 in the connector opening 416. Optionally, the mating face 420 may be disposed between the front and rear sides 424, 426 such that the mating face 420 is smaller or larger than the connector opening 416 in a plane defined by the front side 424 or the rear side 426. The plug end 422 of the peripheral connector 402 is loaded through the connector opening 416 to mate with the panel connector 404. Alternatively, the panel connector 404 may be received in the peripheral connector 402. For example, the panel connector 404 may include a plug end that is received in a mating face of the peripheral connector 402. The mating face 420 may be coplanar with the front side 424 or rear side 426 of the panel 406. Alternatively, the mating face 420 may protrude out of the device 408 past the front side 424. In another embodiment, the mating face 420 is recessed into the device 408 past the rear side 426.

The panel 406 includes securing holes 418 disposed relative to the connector opening 416 to receive securing features 428 of the peripheral connector 402. The panel connector 404 includes mounting ears 430 protruding from opposing sides 432, 434 of the mating face 420. The panel connector 404 may include a different number of mounting ears 430 than the embodiment shown in FIG. 4. The mounting ears 430 may extend from different sides of the mating face 420. The mounting ears 430 include a panel side 448 and a bracket side 450. The panel and bracket sides 448, 450 oppose one another in the illustrated embodiment. The mounting ears 430 include securing holes 436 extending from the panel side 448 to the bracket side 450 that align with the securing holes 418 of the panel 406 when the panel connector 404 is mounted to the panel 406. For example, the securing holes 436 of the mounting ears 430 may be axially aligned with the securing holes 418 of the panel 406. In one embodiment, the securing features 428 of the peripheral connector 402 include an exterior threaded surface. For example, the securing features 428 may include threaded thumbscrews. The threaded securing features 428 may engage the securing holes 436 in the panel connector 404 to secure the peripheral connector 402 to the panel 406 when the peripheral connector 402 and panel connector 404 mate with one another. Alternatively, the threaded securing features 428 may engage the securing holes 418 in the panel 406. In another embodiment, both the securing holes 418 and the securing holes 436 engage the securing features 428.

The panel connector 404 includes a shield 438 that at least partially encloses a body 440 of the panel connector 404. The shield 438 may be electrically coupled with a ground reference of the substrate 410 via the cables 414 to shield the panel connector 404 from electromagnetic interference. As shown in FIG. 4, the mounting ears 430 may be integrally formed with the shield 438 such that the mounting ears 430 and shield 438 form a unitary component. Alternatively, the mounting ears 430 may be separately formed from the shield 438. The shield 438 includes flanges 442 protruding from the panel connector 404 in opposing directions. The flanges 442 may extend in directions parallel to the mating face 420 of the panel connector 404 from opposing sides 444, 446 of the mating face 420. The opposing sides 444, 446 may be transverse to the sides 432, 434 from which the mounting ears 430 protrude. For example, the sides 444, 446 may be approximately perpendicular to the sides 432, 434.

Figure 5:
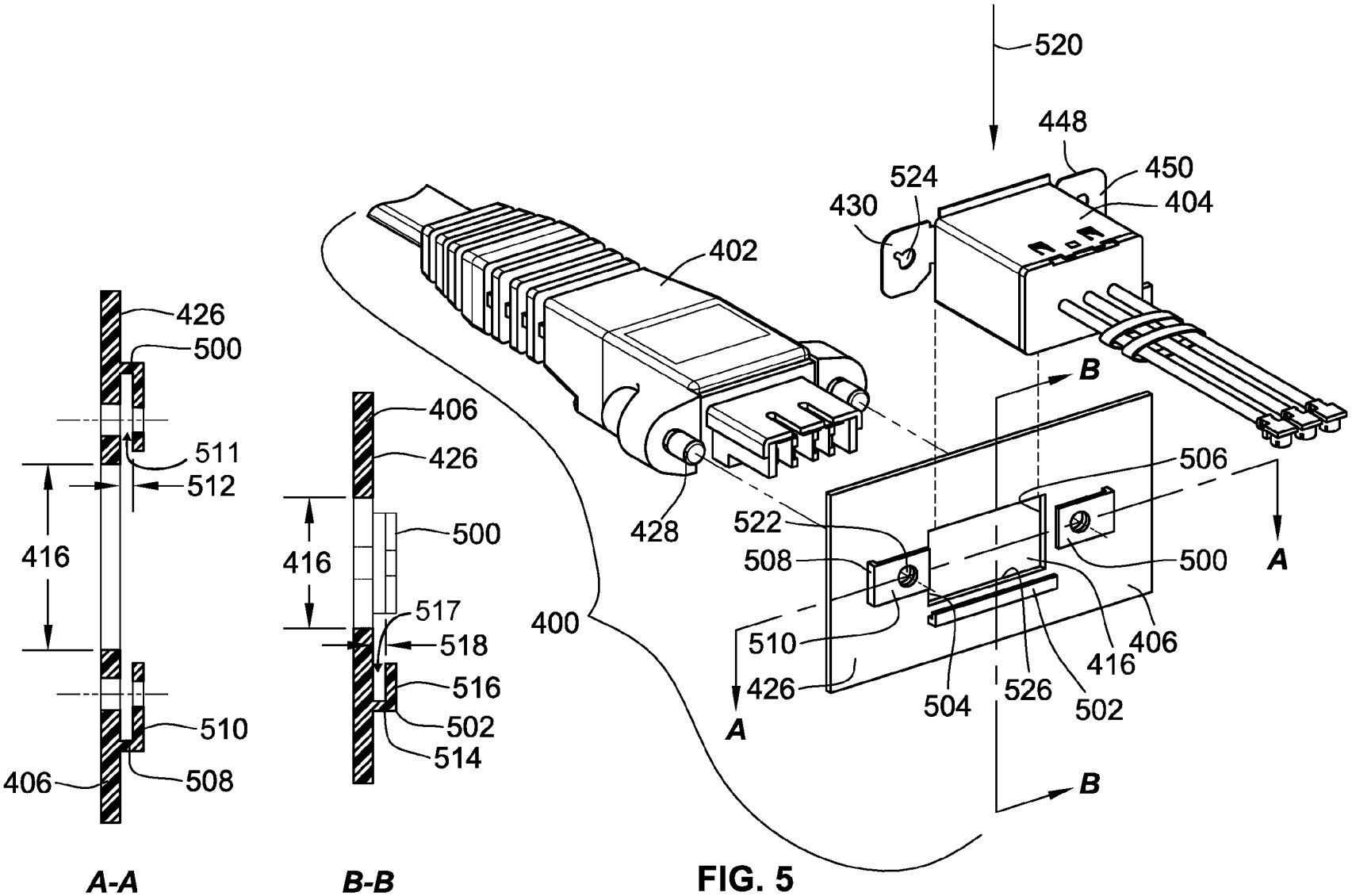
FIG. 5 is another exploded view of the connector assembly shown in FIG. 4.

FIG. 5 is another exploded view of the connector assembly 400. The rear side 426 of the panel 406 includes mounting brackets 500, 502. Alternatively, the panel 406 may include the mounting brackets 500 but not the mounting bracket 502. One or more of the mounting brackets 500, 502 may be integrally formed with the panel 406 to form a unitary body formed of the panel 406 and the corresponding mounting brackets 500, 502. Alternatively, one or more of the mounting brackets 500, 502 may be separately formed from the panel 406. In the illustrated embodiment, the mounting brackets 500 are disposed proximate to opposing sides 504, 506 of the connector opening 416 in the panel 406 and the mounting bracket 502 is located transverse to the mounting brackets 500 proximate to a transverse side 526 of the connector opening 416. The side 526 may be perpendicular to the sides 504, 506. The mounting brackets 500, 502 extend away from the rear side 426 of the panel 406 in a direction transverse to the rear side 426. For example, the mounting brackets 500, 502 may perpendicularly protrude from the rear side 426.

The mounting brackets 500 are shaped and positioned to receive the mounting ears 430 of the panel connector 404. For example, the mounting brackets 500 may be L-shaped with a transverse leg 508 of the mounting bracket 500 transversely extending away from the rear side 426 and a joined leg 510 of the mounting bracket 500 coupled to and transversely extending from the transverse leg 508. In the illustrated embodiment, the transverse leg 508 is disposed approximately perpendicular to the rear side 426 while the joined leg 510 is disposed approximately parallel to the rear side 426. The inset A-A illustrates a cross-sectional view of the panel 406 and mounting brackets 500 taken along line A-A in FIG. 5. As shown in the inset A-A, the joined legs 510 of the mounting brackets 500 are spaced apart from the rear side 426 of the panel 406 by a slot 511 having a slot width 512. When measured in a direction that is perpendicular to the rear side 426 of the panel 406, the slot width 512 may be at least as large as the thickness of the mounting ear 430 that is received in each slot 511. For example, the slot width 512 may be approximately the same as the thickness of the mounting ear 430 between the panel and bracket sides 448, 450 of the mounting ear 430.

The mounting bracket 502 is shaped and positioned to receive one of the flanges 442 (shown in FIG. 4) of the panel connector 404. For example, the mounting bracket 502 may receive the bottom flange 442 that is disposed along the bottom side 444 (shown in FIG. 4) of the mating face 420 (shown in FIG. 4) of the panel connector 404 (shown in FIG. 4). A cross-sectional view of the mounting bracket 502 is shown in the inset B-B in FIG. 5. Similar to the mounting brackets 500, the mounting bracket 502 may be L-shaped with a transverse leg 514 transversely extending away from the rear side 426 of the panel 406 and a joined leg 516 transversely extending from the transverse leg 514. In the embodiment illustrated in FIG. 5, the transverse leg 514 is approximately perpendicular to the panel 406 and the joined leg 516 is approximately perpendicular to the transverse leg 514 and approximately parallel to the rear side 426 of the panel 406. The joined leg 516 is spaced apart from the rear side 426 of the panel 406 by a slot 517 having a slot width 518. When measured in a direction that is perpendicular to the rear side 426 of the panel 406, the slot width 518 may be at least as large as the thickness of the flange 442 disposed along the bottom side 444 of the panel connector 404. For example, the slot width 518 may be approximately the same as the thickness of the flange 442.

The panel connector 404 is mounted to the panel 406 along the rear side 426 thereof by loading the mounting ears 430 into the slots 511 provided by the mounting brackets 500 and by loading the flange 442 (shown in FIG. 4) along the bottom side 444 (shown in FIG. 4) of the panel connector 404 into the slot 517 that is, provided by the mounting bracket 502. The panel connector 404 may be mounted to the panel 406 by moving the panel connector 404 in a direction 520 that is approximately parallel to the rear side 426 of the panel 406. Once the mounting ears 430 are received in the slots 511 and the bottom flange 442 is received in the slot 517, the panel connector 404 is mounted to the rear side 426 of the panel 406. The receipt of the mounting ears 430 and the bottom flange 442 in the mounting brackets 500, 502 may prevent, removal of the panel connector 404 from the panel 406 in a direction away from the rear side 426 of the panel 406.

The mounting brackets 500 include securing holes 522 in the joined legs 5 10. The securing holes 522 extend through the joined legs 510. The securing holes 522 may be aligned with the securing holes 418 (shown in FIG. 4) in the panel 406. For example, the securing holes 418 of the panel 406 may be axially aligned with the securing holes 522 in the mounting brackets 500 in a direction that is approximately perpendicular to at least one of the front side 424 and the rear side 426 of the panel 406. The mounting ears 430 include securing holes 524 that extend through the mounting ears 430 from the panel side 448 to the bracket side 450 of the mounting ears 430. The securing holes 524 of the mounting ears 430 may align with the securing holes 522 of the mounting brackets 500 and the securing holes 418 of the panel 406 when the panel connector 404 is mounted to the panel 406. For example, the securing holes 524 of the mounting ears 430, the securing holes 522 of the mounting brackets 500, and the securing holes 418 of the panel 406 may be axially aligned along a direction that is approximately perpendicular to at least one of the front side 424 and the rear side 426 of the panel 406.

Figure 6:
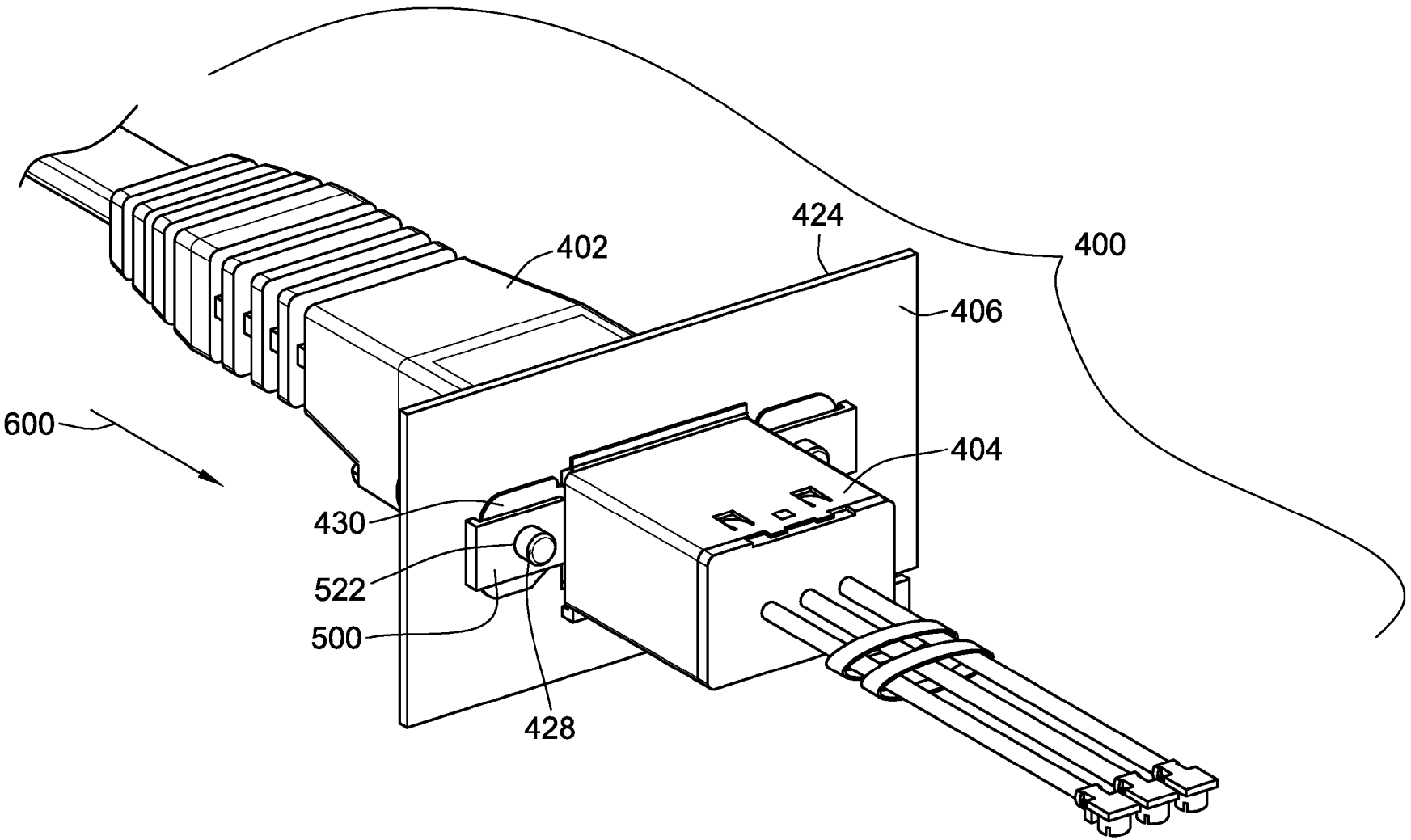
FIG. 6 is a rear perspective view of the connector assembly shown in FIG. 4.

FIG. 6 is a rear perspective view of the connector assembly 400. The securing holes 418 (shown in FIG. 4), 524 (shown in FIG. 5), 522 of the panel 406, the mounting ears 430 and the mounting brackets 500, respectively, may be aligned with one another to receive the securing features 428 of the peripheral connector 402. The peripheral connector 402 may be secured to the panel 406 in the mated relationship with the panel connector 404 shown in FIG. 6 by loading the securing features 428 into one or more of the securing holes 418, 524, 522. For example, the securing features 428 may be loaded into the securing holes 418, 524, 522 through the front side 424 of the panel 406. The securing features 428 may be so loaded into the securing holes 418, 524, 522 by mating the peripheral connector 402 with the panel connector 404 in a mating direction 600 toward the front side 424 of the panel 406. The securing features 428 may include an exterior threaded surface and one or more of the securing holes 418, 524, 522 may include an inner threaded surface. The threaded surfaces may engage one another to secure the peripheral connector 402 to the panel 406 and prevent the peripheral connector 402 from being removed from the mated relationship with the panel connector 404. Alternatively, one or more of the securing holes 418, 524, 522 may be sized to engage an exterior threaded surface of the securing features 428 to secure the peripheral connector 402 to the panel 406.

Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the, above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A panel connector assembly for mounting to a panel having a connector opening extending through the panel from a front side of the panel to a rear side of the panel, the connector assembly comprising:

a panel connector configured for insertion through the connector opening from the front side of the panel, the panel connector having a flange engageable with the front side of the panel, the panel connector being matable with a peripheral connector at the front side of the panel;

a mounting bracket engageable with the rear side of the panel, the mounting bracket having a securing hole alignable with a securing hole in the panel for receiving a securing feature of the peripheral connector; and the panel connector having a tab configured to engage a rear of the mounting bracket such that the mounting bracket and the panel are held between the tab and the flange.

2. The assembly of claim 1, wherein the panel connector is mounted to the rear side of the panel by the mounting bracket.

3. The assembly of claim 1, wherein the panel connector includes a body, the tab forwardly protruding from the body toward the rear side of the panel, wherein the mounting bracket is secured between the tab of the panel connector and the rear side of the panel.

4. The assembly of claim 1, wherein the securing feature of the peripheral connector is a threaded screw, the mounting bracket receiving the securing feature to prevent removal of the peripheral connector from the panel connector.

5. The assembly of claim 1, wherein the mounting bracket contacts the rear side of the panel when the mounting bracket engages the panel.

6. The assembly of claim 1, wherein the mounting bracket concurrently engages the panel and the panel connector when the panel connector is mounted to the panel.

7. The assembly of claim 1, wherein the mounting bracket includes a collar circumscribing the connector opening in the panel.

8. The assembly of claim 1, wherein, when the mounting bracket receives the securing feature of the peripheral connector, the mounting bracket is forced toward the rear side of the panel.

9. The assembly of claim 1, wherein the flange of the panel connector prevents removal of the panel connector through the connector opening toward the rear side of the panel.

10. The assembly of claim 1, wherein the mounting bracket is placed around the panel connector from the rear side of the panel.

* * * * *